United States Patent [19]

Bergeron et al.

[11] 4,067,126

[45] Jan. 10, 1978

[54] CROSS-COUNTRY TYPE SKI BOOTS

[75] Inventors: Normand A. Bergeron, Boucherville; Claude E. Villeneuve, Montreal, both of Canada

[73] Assignee: Les Chaussures de Randonnai Shoes, Inc., Canada

[21] Appl. No.: 719,252

[22] Filed: Aug. 31, 1976

[51] Int. Cl.[2] ..... A43B 5/04; A43B 23/00

[52] U.S. Cl. ..... 36/117; 36/107; 36/45

[58] Field of Search ..... 36/107, 83, 56, 57, 36/45, 117, 118, 119, 120, 121

[56] References Cited

U.S. PATENT DOCUMENTS

| | | | |
|---|---|---|---|
| 1,963,577 | 6/1934 | Cuozzo | 36/83 |
| 3,795,991 | 3/1974 | Borjesson | 36/117 |

FOREIGN PATENT DOCUMENTS

| | | | |
|---|---|---|---|
| 1,285,271 | 1/1962 | France | 36/117 |
| 1,685,349 | 8/1971 | Germany | 36/117 |
| 2,262,279 | 6/1974 | Germany | 36/107 |
| 312,718 | 4/1956 | Switzerland | 36/117 |

*Primary Examiner*—Patrick D. Lawson

*Attorney, Agent, or Firm*—Diller, Brown, Ramik & Wight

[57] ABSTRACT

A cross-country type ski boot which comprises a boot upper for receiving a foot therein and being attached to a sole. The sole has at least a front edge extending beyond a toe portion of the boot upper to define a front ledge portion. The boot upper has a reinforcing fabric piece secured on the toe portion and having a securable free end which extends beyond a lower end of the toe portion. The securable free end is secured to the front ledge portion forwardly of the toe portion.

8 Claims, 5 Drawing Figures

CROSS-COUNTRY TYPE SKI BOOTS

BACKGROUND OF THE INVENTION a. Field of the Invention

The present invention relates to an improved cross-country type ski boot construction wherein the toe portion of the boot is reinforced to prevent the boot upper from detaching itself from the sole in the front toe portion of the boot.

b. Description of Prior Art

Various ski boot constructions are known. This invention relates to a specific type of ski boot known as a cross-country ski boot. This type of ski boot is normally attached to a ski harness in the toe portion of the boot, only. Conventional types of cross-country ski boot harnesses comprise pins protruding into the bottom face of the sole in the front portion thereof with a clamp, spring biased downwardly, on a front ledge portion of the sole. The front portion of the sole is secured to the ski to permit the wearer to pivot its foot on the toe portion thereof as he strides on the snow with the skis. Thus, the secured front portion of the boot acts as a pivot and the rear portion of the boot lifts from the top of the ski during every stride of the skier.

This pivotal action of the ski boot causes the front toe portion of the boot upper to detach itself from the sole portion as the front portion of the sole is rigidly secured to the ski and the wearer's foot exerts an outward pressure on the fabric of the boot upper causing it to detach itself in the front portion thereof.

SUMMARY OF THE INVENTION

It is a feature of the present invention to overcome the above-mentiond disadvantage whereby to prevent the front portion of the boot upper from detaching itself from the sole of the boot.

It is a further feature of the present invention to provide a cross-country type ski boot construction having a novel front portion construction which is a substantial improvement over prior art cross-country type ski boots.

According to the above features, from a broad aspect, the present invention provides a cross-country type ski boot comprising a boot upper for receiving a foot therein, said boot upper being attached to a sole, said sole having at least a front edge extending beyond a toe portion of said boot upper to define a front ledge portion, said boot upper having a reinforcing fabric piece secured on said toe portion and having a securable free end extending beyond a lower edge of said toe portion, said securable free end being secured to said front ledge portion forwardly of said toe portion.

BRIEF DESCRIPTION OF THE DRAWINGS

A preferred embodiment of the present invention will now be described with reference to an example as illustrated in the accompanying drawings in which.

DESCRIPTION OF THE PRREFERRED EMBODIMENTS

Figure 1:
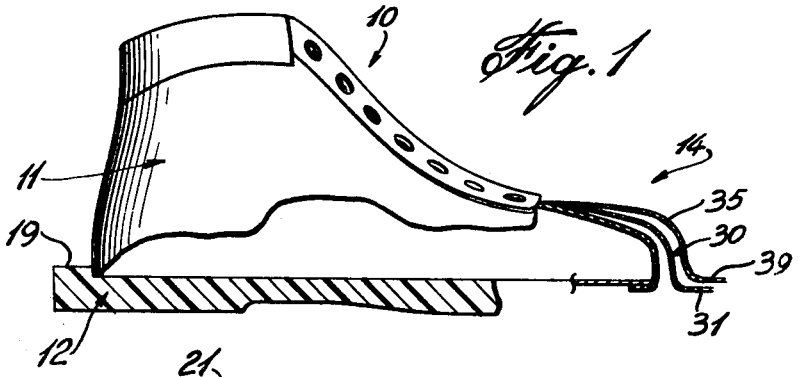
FIG. 1 is a fragmented side view of a cross-country ski boot upper constructed in accordance with the invention.

Referring now to the drawings, there is shown generally at 10 the cross-country type ski boot of the present invention. The boot consists essentially of a boot upper 11 secured to a sole 12 of rubber or the like material. As is conventional with ski boots, the sole has a front edge 13 extending beyond a toe portion 14 of the boot upper 11 to define a front ledge portion 15 for securement in a ski harness, not shown.

Figure 2:
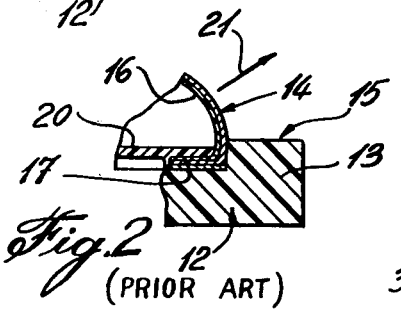
Fig. 2 (PRIOR ART)
FIG. 2 is a fragmented section view of the front portion of a cross-country ski boot of the prior art type.
Figure 4:
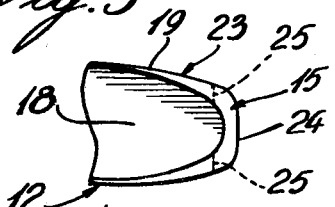
FIG. 4 is a fragmented plan view of a cross-country ski boot sole.

In the prior art, see FIG. 2, the fabric pieces 16 of the toe portion 14 extend inwardly, as shown at 17, under the boot upper 11 and are secured along a peripheral edge portion of a cavity 18 provided in the upper face 19 of the sole 12 (see FIG. 4). As shown in FIG. 2, an inner sole 20 is positioned inside the boot upper to provide a smooth inner bottom surface. The inwardly turned edges are normally glued to the peripheral marginal edge of the cavity 18. Stiches may also be provided along the inwardly turned marginal edge. With such prior art boot construction the front ledge portion 15 of the sole is usually clamped down rigidly and immovably by a cross-country ski harness (not shown) to provide pivotal movement of the boot from the front clamped portion thereof. During normal cross-country skiing motion, an outward pressure is exerted by the foot of the wearer on the top fabric portion of the ski boot in the direction of arrow 21. This constant motion and pressure causes the front portion 14 of the ski boot to detach itself from the front marginal edge of the cavity 18 thus destroying the ski boot.

With the present invention, there is provided a reinforcing fabric piece 30 secured on the toe portion 14 and having a securable free end 31 which extends beyond the lower edge of the toe portion 14. The securable free end 31 is secured to the front ledge portion 15 of the sole 12 in the following manner.

As shown in FIG. 4, the sole 12 is provided with a boot upper cavity 18 which defines a flat base 22. The portion of the sole about the cavity 18 constitutes an elevated peripheral ledge 23 extending about the cavity. In order to attach the securable free end 31 and the reinforcing fabric piece 30 to the front ledge portion 15, the front ledge portion 15 is slit horizontally from a front edge 24 thereof and extending to the cavity 18. This slit is clearly shown in FIG. 3 and identified by numeral 26. The extent of the slit is shown by the dotted lines 25 in FIG. 4.

Figure 3:
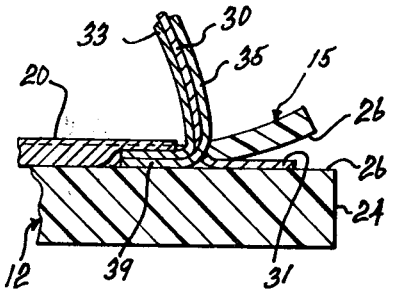
FIG. 3 is a view similar to FIG. 2 but illustrating the attachment of the reinforcing fabric piece of the present invention.

Referring now more specifically to FIGS. 1 and 3, it can be seen that the toe portion 14 of the boot 10 is provided with an inner fabric layer 33 having a lower edge thereof inwardly turned and secured along the peripheral marginal edge of the base of the cavity 18, by suitable fastening means such as glue or stitches. An outer fabric piece 35 is also secured over a section of the toe portion 14 with the reinforcement fabric piece 30 being positioned and secured between the inner fabric layer 33 and the outer fabric layer 35 by stitches 41 (see FIG. 5). The securable free end 31 of the reinforcing fabric 30 is positioned in the slot 26 and the slitted portion of the front edge is then glued back together over the securable free end 31. Fastener elements 43 (see FIG. 5) may be inserted in the front ledge portion 15 and extend at least through the securable free end 31 of the reinforcing fabric piece 30 to provide additional retention.

Figure 5:
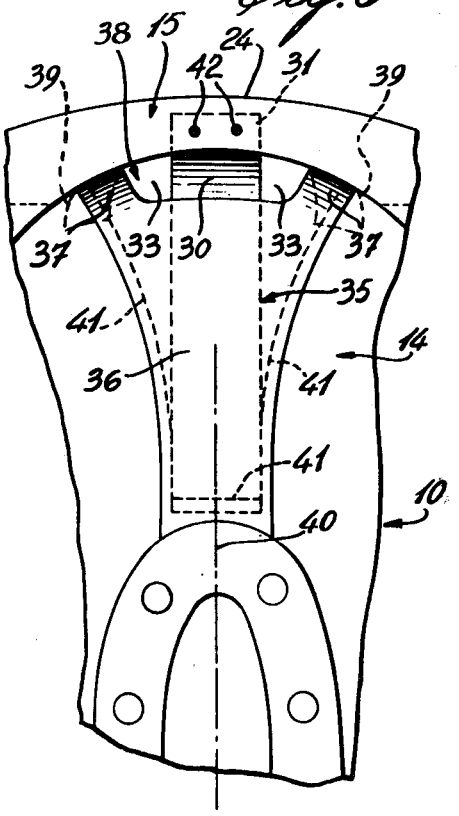
FIG. 5 is a fragmented top view of a cross-country ski boot constructed in accordance with the present invention.

As seen in FIG. 5, the outer fabric piece 35 is of Y-shape configuration defining a main body section 36, two diverging end arms 37 and an opening 38 between said arms 37. Each diverging end arms has an attachable free end 39 which is also inwardly turned and secured in the marginal edge of the cavity 18 under the lower edge of the fabric layer 33. As herein shown the reinforcing fabric piece 30 is an elongated strip of reinforcing nylon material which is rubber covered. The reinforcing strip 30 is secured centrally on the toe portion 14 in alignment with the central longitudinal axis 40 of the boot 10. The strip 30 also extends between the two diverging end arms 37 and is visible from the outside of the boot in the opening 38 between the arms 37.

It can be seen that with this type of construction of the toe portion 14 of the ski boot, the clamping pressure applied on the front ledge portion 15 of the boot maintains the securable free end 31 of the reinforcing piece 30 in clamping pressure. Thus, as the boot pivots on the toe portion thereof, the stress is applied on the reinforcing piece 30 and it maintains the front portion construction of the boot in solid attachment with the sole 12. With this type of construction the above noted defects of the prior art cross-country ski boots has been overcome.

Pull test experiments have been made with conventional cross-country type ski boots to determine the force required to pull apart the front portion of the ski boot upper from the sole portion and with conventional ski boots it has been found that when a boot comes apart with a pull force of 100 to 125 pounds, the boot is considered acceptable. However, with a cross-country ski boot constructed in accordance with the present invention, the maximum pull force of 255 pounds of the test machine was applied to the front portion of the ski boot and no separation was apparent.

It is within the ambit of the present invention to cover any obvious modifications of the embodiment thereof described, provided such modifications fall within the monopoly defined by the appended claims.

We claim:

1. A cross-country type ski boot comprising a boot upper for receiving a foot therein, said boot upper being attached to a sole, said sole having at least a front edge extending beyond a toe portion of said boot upper to define a front ledge portion, said boot upper having a reinforcing fabric piece secured on said toe portion and having a securable free end extending beyond a lower edge of said toe portion, said securable free end being secured to said front ledge portion forwardly of said toe portion, said front ledge portion being provided with a horizontal slot in at least a portion thereof aligned with said securable free end to receive and secure said securable free end therein, said sole being provided with a boot upper cavity in a top surface thereof, said cavity having a flat base, an elevated peripheral ledge defined about said cavity, and said horizontal slot being constituted by slitting said front ledge portion from a front edge thereof to said cavity and in horizontal alignment with an upper surface of said flat base.

2. A ski boot as claimed in claim 1 wherein said toe portion is formed of an inner fabric layer having a lower edge thereof inwardly turned and secured on a peripheral marginal edge of said flat base, an outer fabric piece secured over a section of said toe portion, said reinforcing fabric piece being secured between said inner fabric layer and said outer fabric piece.

3. A ski boot as claimed in claim 2 wherein said outer fabric piece is of Y-shape configuration defining a main body section, two diverging end arms and an opening between said arms; said diverging end arms having an attachable free end, each attachable free end being inwardly turned and secured under said inner fabric layer lower edge on said peripheral marginal edge of said flat base.

4. A ski boot as claimed in claim 3 wherein said reinforcing fabric piece is an elongated strip of reinforcing material, said strip being fastened centrally on said toe portion in alignment with the central longitudinal axis of said boot, said strip extending between said two diverging end arms through said opening between said arms.

5. A ski boot as claimed in claim 4 wherein said reinforcing fabric piece is a nylon strip stitched between said inner fabric layer and said outer fabric piece.

6. A ski boot as claimed in claim 4 wherein said opening between said two diverging arms is positioned in a front portion of said toe portion above said front ledge of said sole.

7. A ski boot as claimed in claim 3 wherein said securable free end of said reinforcing fabric piece is glued in said horizontal slot.

8. A ski boot as claimed in claim 7 wherein said slitted front ledge portion is glued together with said securable free end in said slot, and fastener elements extending transversely in said front ledge portion and extending through said securable free end of said reinforcing fabric piece.

* * * * *